US011298744B2

(12) United States Patent
Xu et al.

(10) Patent No.: US 11,298,744 B2
(45) Date of Patent: Apr. 12, 2022

(54) CONTINUOUS-CURVATURE CONVEX ROLL FOR CONTINUOUSLY CASTING BLOOM, AND MANUFACTURING METHOD THEREFOR

(71) Applicant: BAOSHAN IRON & STEEL CO., LTD., Shanghai (CN)

(72) Inventors: Rongjun Xu, Shanghai (CN); Junjiang Liu, Shanghai (CN); Genjie Wan, Shanghai (CN); Chengbin Li, Shanghai (CN); Xiangchun Liu, Shanghai (CN); Qingyu Meng, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 0 days.

(21) Appl. No.: 17/271,094

(22) PCT Filed: Aug. 16, 2019

(86) PCT No.: PCT/CN2019/101036
§ 371 (c)(1),
(2) Date: Feb. 24, 2021

(87) PCT Pub. No.: WO2020/042923
PCT Pub. Date: Mar. 5, 2020

(65) Prior Publication Data

US 2021/0316358 A1 Oct. 14, 2021

(30) Foreign Application Priority Data

Aug. 31, 2018 (CN) ..... 201811011524.5

(51) Int. Cl.
*B22D 11/128* (2006.01)
*B22D 11/12* (2006.01)

(52) U.S. Cl.
CPC ..... *B22D 11/1287* (2013.01); *B22D 11/1206* (2013.01)

(58) Field of Classification Search
CPC .... B22D 11/12; B22D 11/128; B22D 11/1287
(Continued)

(56) References Cited

FOREIGN PATENT DOCUMENTS

CN 1528545 A 9/2004
CN 104399924 A 3/2015
(Continued)

OTHER PUBLICATIONS

International Search Report dated Nov. 19, 2019 for PCT Patent Application No. PCT/CN2019/101036.
(Continued)

*Primary Examiner* — Kevin P Kerns
(74) *Attorney, Agent, or Firm* — Lei Fang; Smith Tempel Blaha LLC

(57) ABSTRACT

Disclosed are a continuous-curvature convex roll for continuously casting a bloom, and a manufacturing method therefore. An outer contour curve of a working portion of a body of the continuous-curvature convex roll contains a first straight-line segment (AB), a first transition curve segment (BC), an intermediate straight-line segment (CD), a second transition curve segment (DE) and a second straight-line segment (EF). The BC, the AB, and the CD have continuous first-order derivatives, continuous second-order derivatives, and continuous curvatures, thus forming a first transition curve with a continuous curvature. The BC and the DE are mirror-symmetrical. The continuous-curvature convex roll can uniformly deform a blank cast in a deformation area, thereby reducing cracks. The transition curve of the convex roll can be reduced, thereby being capable of further reducing a rolling pressure and the withdrawal resistance.

6 Claims, 1 Drawing Sheet

(58) Field of Classification Search
USPC ..... 164/442, 448, 484
See application file for complete search history.

(56) References Cited

FOREIGN PATENT DOCUMENTS

| | | | |
|---|---|---|---|
| CN | 105983668 | A | 10/2016 |
| CN | 106001475 | A | 10/2016 |
| CN | 205834144 | U | 12/2016 |
| CN | 107377919 | A | 11/2017 |
| RU | 2120349 | C1 | 10/1998 |

OTHER PUBLICATIONS

Written Opinion dated Nov. 19, 2019 for PCT Patent Application No. PCT/CN2019/101036.
Supplementary European Search Report dated Aug. 16, 2021 for EP 19855234.1-1103, published as EP 3 845 329.

CONTINUOUS-CURVATURE CONVEX ROLL FOR CONTINUOUSLY CASTING BLOOM, AND MANUFACTURING METHOD THEREFOR

CROSS-REFERENCE TO RELATED APPLICATIONS

This application is a 371 U.S. National Phase of PCT International Application No. PCT/CN2019/101036 filed on Aug. 16, 2019, which claims benefit and priority to Chinese patent application no. CN 201811011524.5 filed on Aug. 31, 2018, the contents of both are incorporated by reference herein in their entireties.

TECHNICAL FIELD

The present disclosure pertains to the field of metal casting, and particularly relates to a method of manufacturing an apparatus for in-situ post-treatment or post-processing of a casting slab.

BACKGROUND ART

Chinese patent application for invention No. CN 107377919 A published on Nov. 24, 2017 discloses a "method for increasing the center density of a cast slab of bearing steel", wherein there is disclosed a convex roll, wherein a protrusion 1 is provided in the middle of the convex roll, and there is a transition between the protrusion 1 and the two ends of the convex roll in the form of a curve having a gradually varying curvature.

Chinese patent application for invention No. CN 106001475 A published on Oct. 12, 2016 discloses a "gradually varying curvature convex roll and a heavy reduction process for a continuous casting alloy steel bloom", wherein the roll is designed as a convex roll structure having a gradually varying curvature, wherein the convex roll has a protuberance height that can compensate for the volume shrinkage in the height direction, and a protuberance width that can cover the most severely loose segregation area in the width direction. The arc in the varying arc zone is controlled so that the radius of curvature r is not greater than 30 mm.

Chinese patent application for invention No. CN 105983668 A published on Oct. 5, 2016 discloses a "soft reduction roll, a soft reduction device comprising the same, and a method for manufacturing a cast slab", wherein it discloses that "the soft reduction roll has a diameter that is smaller at the end part than in the middle part, wherein when the cross section of the soft reduction roll comprising a rotation axis is observed, the outer periphery between the middle part and the end part has a first arc bulging toward the rotation axis at the end side, and a second arc bulging in a direction opposite to the bulging direction of the first arc at the middle part side, wherein a tangent line tangent to both the first arc and the second arc forms an angle of 40° or less with the rotation axis."

SUMMARY

As regards the soft reduction convex roll in the above-mentioned technical solutions, although the smoothness of the profile curve of the protuberance is considered respectively, it is only continuous in terms of a first-order derivative (that is, curve-curve tangent, curve-straight line tangent). These tangent points are still singular points, that is, stress concentration points. For example, the intersection of two arc curves only satisfies 0-order continuity, and thus the curves do not form a smooth curve in the true sense. The casting slab is still inevitably stressed during the rolling deformation process. Because the surface temperature of the continuous casting slab is usually 700-900° C., and the surface temperature is not uniform, the singular points become stress concentration points, where cracks tend to be generated in the surface during the rolling deformation process of the casting slab.

When two arc curves are used at the same time to form a transition curve, the projection length AB of the transition curve on the x axis must be greater than or equal to the height H of the protuberance. That is, the sum of the minimum radii of the two arcs ($R_1$+$R_2$) must be greater than or equal to the height H of the protuberance; otherwise the two arcs cannot be connected.

Since the total length of the roll body is fixed, the length of the straight line section DE in the center of the protuberance depends on the width of the unsolidified liquid core in the center of the casting slab. An excessively long transition curve means that the straight line sections AB and EF at both ends of the protuberance become shorter, which is not conducive to reducing the rolling pressure or the withdrawal resistance.

The technical problem to be solved by the present disclosure is to provide a method of manufacturing a continuous curvature convex roll for a continuous casting bloom. The profile curve of the working part of the roll body of the continuous curvature convex roll features first-order derivative continuity, second-order derivative continuity and curvature continuity. There is also provided a method of forming a transition curve having a continuous curvature. The continuous curvature convex roll can uniformly deform the casting bloom in the deformation zone and reduce the occurrence of cracking. The transition curve of the continuous curvature convex roll may be shortened, which can further reduce the rolling pressure and reduce the withdrawal resistance.

The technical solution of the present disclosure is to provide a method of manufacturing a continuous curvature convex roll for a continuous casting bloom, wherein:

an outer profile curve of a working part of a roll body of the continuous curvature convex roll body is composed of a first straight line section AB, a first transition curve section BC, an intermediate straight line section CD, a second transition curve section DE, and a second straight line section EF;

wherein the first transition curve section BC, the first straight line section AB, and the intermediate straight line section CD have first-order derivative continuity, second-order derivative continuity, and curvature continuity, forming a first transition curve having a continuous curvature;

wherein, similarly, the second transition curve section DE, the intermediate straight line section CD and the second straight line section EF have first-order derivative continuity, second-order derivative continuity, and curvature continuity, forming a second transition curve having a continuous curvature;

the first transition curve BC and the second transition curve DE are mirror symmetrical;

wherein when manufacturing and processing the convex roll, a blank is first cast according to shape and size requirements of the convex roll, and then the working part of the roll body is formed by subjecting the blank to rotational processing along a central axis $O_1O_2$ according to a shape of the outer profile curve to form the continuous curvature convex roll;

wherein for an existing flat roll, a protuberance is first formed on the flat roll at a position corresponding to the working part of the roll body by resurfacing welding, and then the working part of the roll body is formed by subjecting the protuberance to rotational processing along a central axis $O_1O_2$ according to a shape of the outer profile curve to form the continuous curvature convex roll.

The convex roll manufactured according to the method of manufacturing a continuous curvature convex roll for a continuous casting bloom can uniformly deform the casting bloom in the deformation area and reduce the occurrence of cracking.

The transition curve of the convex roll manufactured according to the method of manufacturing a continuous curvature convex roll for a continuous casting bloom can be shortened, which can further reduce the rolling pressure and withdrawal resistance.

Specifically, the method of forming the transition curve having a continuous curvature is as follows:

establishing a coordinate system, wherein an origin of coordinates is positioned at a middle point O, points O and B meet second-order derivative continuity, and point A meets first-order derivative continuity;

wherein a curve equation of the protuberance of the convex roll depicts a curve that is axisymmetric about the central point A, a curve section OA is a left half of the curve, and a curve section AB is a right half of the curve;

wherein the curve section OA serves as a left half curve of the protuberance, the curve section AB serves as a right half curve of the protuberance, and they are connected with a horizontal straight line therebetween.

Further, as regards the curve equation,

The restrictions are as follows:

Point $O$: $x = 0$:

$$y = 0; \tag{1}$$

$$\frac{dy}{dx} = 0; \tag{2}$$

$$\frac{d^2y}{dx^2} = 0; \tag{3}$$

Point $A$: $x = L/2$:

$$y = H; \tag{4}$$

$$\frac{dy}{dx} = 0. \tag{5}$$

Point $B$: $x = L$:

$$y = 0; \tag{6}$$

$$\frac{dy}{dx} = 0; \tag{7}$$

$$\frac{d^2y}{dx^2} = 0; \tag{8}$$

That is, there are a total of 8 restrictions.

Assuming that the transition curve of the protuberance is in polynomial form, as there are 8 restrictions, there should be:

$$y = a_7x^7 + a_6x^6 + a_5x^5 + a_4x^4 + a_3x^3 + a_2x^2 + a_1x + a_0 \tag{9}$$

$$\frac{dy}{dx} = 7a_7x^6 + 6a_6x^5 + 5a_5x^4 + 4a_4x^3 + 3a_3x^2 + 2a_2x + a_1 \tag{10}$$

$$\frac{d^2y}{dx^2} = 42a_7x^5 + 30a_6x^4 + 20a_5x^3 + 12a_4x^2 + 6a_3x + 2a_2 \tag{11}$$

The restrictions of Formulas (1)-(8) are input into Formulas (9), (10), (11), and a system of linear equations in eight unknowns is solved to obtain:

$$a_0 = 0;\ a_1 = 0;\ a_2 = 0;$$

$$a_3 = \frac{64H}{L^3};\ a_4 = -\frac{192H}{L^4};\ a_5 = \frac{192H}{L^4};\ a_6 = -\frac{64H}{L^6};\ a_7 = 0;$$

$$y = -\frac{64H}{L^6}x^6 + \frac{192H}{L^5}x^5 - \frac{192H}{L^4}x^4 + \frac{64H}{L^3}x^3$$

This curve has a continuous curvature because of its zero-order, first-order and second-order derivative continuity. Hence, it is a smooth curve.

Furthermore, the second transition curve DE can be formed as a mirror image of the first transition curve BC about a center line passing through the midpoint of the intermediate straight line section CD.

According to the abovementioned method, a continuous curvature convex roll for a continuous casting bloom can also be obtained.

Compared with the prior art, the present disclosure includes the following advantages:

1. The continuous curvature convex roll manufactured using the present technical solution can uniformly deform the casting bloom in the deformation zone and reduce the occurrence of cracking. With the use of the inventive technical solution, the transition curve of the convex roll may be shortened, which can further reduce the rolling pressure and reduce the withdrawal resistance.

2. When the convex roll manufactured using the present technical solution is used to control the soft reduction at the solidification end, the center porosity of the cast bloom may be reduced, so that the center density of the cast bloom may be increased, and the internal quality of a rolled material may be improved.

3. When the convex roll manufactured using the present technical solution is used to implement the heavy reduction process at the solidification end, the solidified bloom shells on both sides are prevented from generating large deformation resistance, and the heavy reduction can be applied to the middle part of the casting bloom to increase the center density of the casting bloom. At the same time, due to the small contact area between the convex roll and the casting bloom, the friction is reduced, so the withdrawal resistance is also reduced in the continuous casting process of the casting bloom.

DETAILED DESCRIPTION

The present disclosure will be further illustrated with reference to the accompanying drawings and the following Examples.

The object of the present disclosure is to provide a soft reduction roll capable of sufficiently reducing defects generated in the surface of a rolled material.

Figure 1:
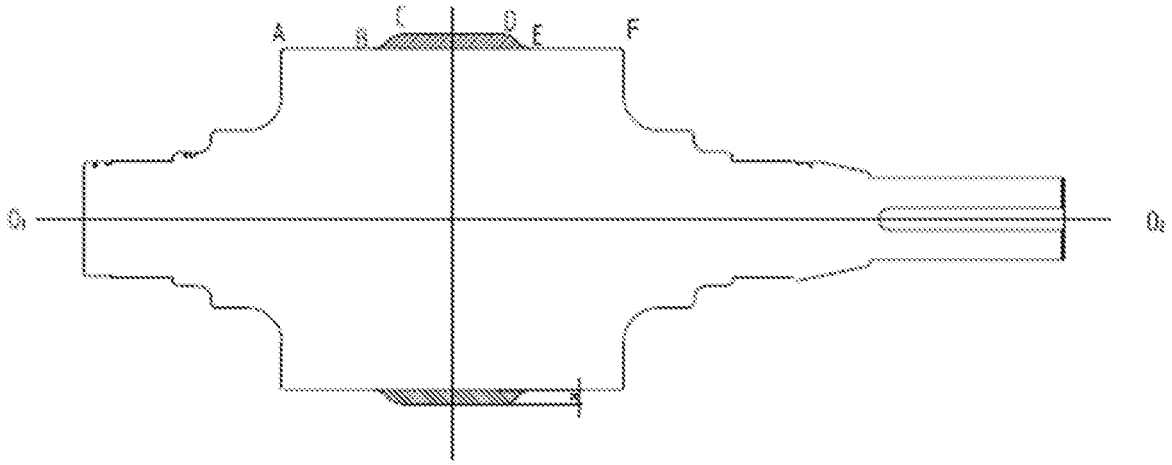
FIG. 1 shows schematically a profile of a convex roll according to the present disclosure.

To achieve the above object, the disclosure utilizes the following technical solution:

as shown by FIG. 1, the profile curve of the working part of the roll body of the continuous curvature convex roll body according to the present disclosure is composed of a first straight line section AB, a first transition curve section BC, an intermediate straight line section CD, a second transition curve section DE, and a second straight line section EF.

The first transition curve section BC, the first straight line section AB, and the intermediate straight line section CD have first-order derivative continuity, second-order derivative continuity, and curvature continuity.

Similarly, the second transition curve section DE, the intermediate straight line section CD and the second straight line section EF have first-order derivative continuity, second-order derivative continuity, and curvature continuity.

Figure 2:
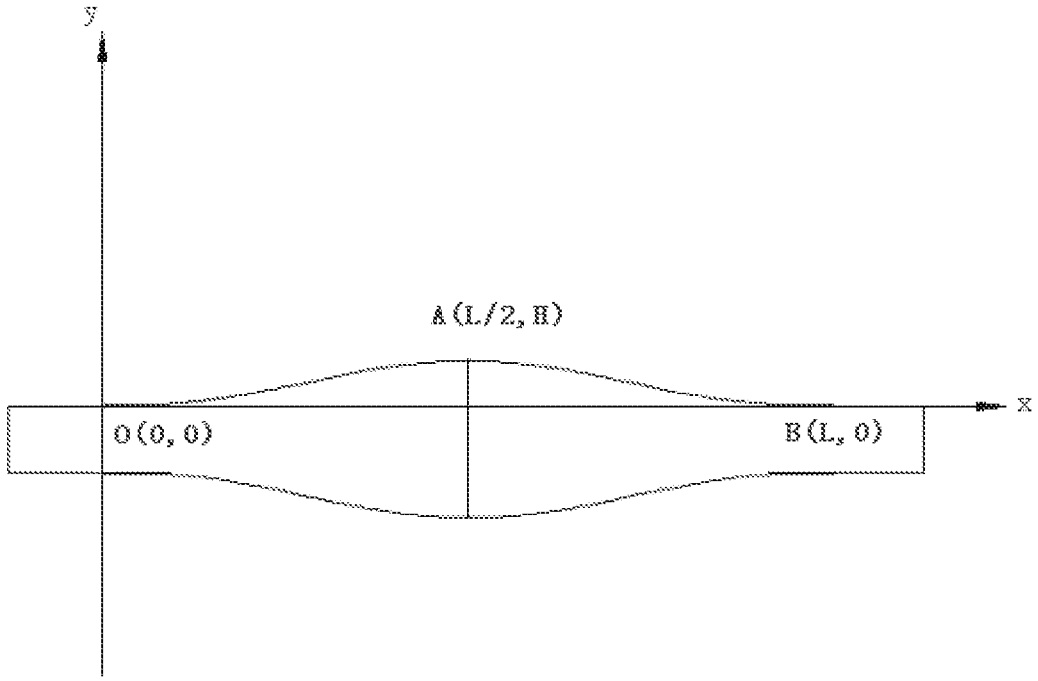
FIG. 2 shows schematically a coordinate system built in the horizontal cross section of the protuberance according to the present disclosure.

The method of forming the first transition curve having a continuous curvature is as follows:

establishing a coordinate system as shown by FIG. 2 (wherein an origin of coordinates is positioned at a middle point O, points O and B meet second-order derivative continuity, and point A meets first-order derivative continuity).

In this technical solution, a curve equation of the protuberance of the convex roll depicts a curve that is axisymmetric about the central point A, a curve section OA is a left half of the curve, and a curve section AB is a right half of the curve. The curve section OA serves as a left half curve of the protuberance, the curve section AB serves as a right half curve of the protuberance, and they are connected with a horizontal straight line therebetween.

The curve equation of the first transition curve of the convex roll protuberance is obtained by the following steps:

The restrictions are as follows:

Point $O$: $x = 0$:

$$y = 0; \tag{1}$$

$$\frac{dy}{dx} = 0; \tag{2}$$

$$\frac{d^2y}{dx^2} = 0; \tag{3}$$

Point $A$: $x = L/2$:

$$y = H; \tag{4}$$

$$\frac{dy}{dx} = 0. \tag{5}$$

Point $B$: $x = L$:

$$y = 0; \tag{6}$$

$$\frac{dy}{dx} = 0; \tag{7}$$

$$\frac{d^2y}{dx^2} = 0; \tag{8}$$

That is, there are a total of 8 restrictions.

Assuming that the transition curve of the protuberance is in polynomial form, as there are 8 restrictions, there should be:

$$y = a_7x^7 + a_6x^6 + a_5x^5 + a_4x^4 + a_3x^3 + a_2x^2 + a_1x + a_0 \tag{9}$$

$$\frac{dy}{dx} = 7a_7x^6 + 6a_6x^5 + 5a_5x^4 + 4a_4x^3 + 3a_3x^2 + 2a_2x + a_1 \tag{10}$$

$$\frac{d^2y}{dx^2} = 42a_7x^5 + 30a_6x^4 + 20a_5x^3 + 12a_4x^2 + 6a_3x + 2a_2 \tag{11}$$

The restrictions of Formulas (1)-(8) are input into Formulas (9), (10), (11), and a system of linear equations in eight unknowns is solved to obtain:

$$a_0 = 0;\ a_1 = 0;\ a_2 = 0;$$

$$a_3 = \frac{64H}{L^3};\ a_4 = -\frac{192H}{L^4};\ a_5 = \frac{192H}{L^4};\ a_6 = -\frac{64H}{L^6};\ a_7 = 0.$$

$$y = -\frac{64H}{L^6}x^6 + \frac{192H}{L^5}x^5 - \frac{192H}{L^4}x^4 + \frac{64H}{L^3}x^3$$

This curve has a continuous curvature because of its zero-order, first-order and second-order derivative continuity. Hence, it is a smooth curve.

The above second transition curve DE can be formed as a mirror image of the first transition curve BC about a center line passing through the midpoint of the intermediate straight line section CD.

The beneficial effects of using the technical solution of the present disclosure are:

According to the present technical solution, the convex roll is used to control the soft reduction at the solidification end, and it is used comprehensively to reduce the center porosity, so as to increase the center density of the cast bloom, and improve the internal quality of a rolled material (large volume shrinkage of a casting bloom will occur during solidification of the casting bloom, so a larger reduction is needed to compensate for the volume shrinkage of the casting bloom. During the reduction process, deformation resistance will be introduced in the casting bloom, and it will be mainly concentrated in the solidified shells on both sides).

When the convex roll of the present disclosure is used to implement a heavy reduction process at the solidification end, the solidified bloom shells on both sides are prevented from generating large deformation resistance, and the heavy reduction can be applied to the middle part of the casting bloom to increase the center density of the casting bloom.

At the same time, due to the small contact area between the convex roll and the casting bloom, the friction is reduced, so the withdrawal resistance is also reduced in the continuous casting process of the casting bloom.

In addition, as a key point, when the continuous curvature convex roll manufactured using the present technical solution is operated in a soft reduction mode, the convex roll can uniformly deform the casting bloom in the deformation zone and reduce the occurrence of cracking. The transition curve of the convex roll manufactured according to the present disclosure may be shortened, which can further reduce the rolling pressure and withdrawal resistance.

In the implementation according to the present disclosure, a blank is first cast according to shape and size requirements of the convex roll of the present disclosure, and then the working part of the roll body is formed by subjecting the blank to rotational processing along a central axis $O_1O_2$ according to a shape of the outer profile curve shown by FIG. 1 to form the continuous curvature convex roll. For an existing flat roll, a protuberance is first formed on the flat roll at a position corresponding to the working part of the roll body by resurfacing welding, and then the working part of the roll body is formed by subjecting the protuberance to rotational processing along a central axis $O_1O_2$ according to the shape of the outer profile curve shown by FIG. 1 to form the continuous curvature convex roll.

EXAMPLES

For the aforementioned first straight line section AB, third straight line section EF, intermediate straight line section CD, first transition curve BC, and second transition curve DE, where possible, they are referred to using the letters at the beginning and end of the line sections to facilitate the concise description of the text.

Example 1

In the coordinate system shown by FIG. 2 (the origin of coordinates was positioned at the middle point O, the two points O and B met second-order derivative continuity, and point A met first-order derivative continuity), the length of the working roll body of the roll was 500 mm; the length of the two straight line sections was AB=EF=135 mm; the length of the intermediate straight line section CD was 150 mm; the projection length of the transition curves BC and DE on the x axis was 40 mm; the height of the protuberance was H=20 mm; and the curve equation of the transition curve BC was:

$$y=-4.882813\times10^{-9}x^6+1.171875\times10^{-6}x^5-9.375\times10^{-5}x^4+2.5\times10^{-3}x^3$$

The second transition curve DE was formed as a mirror image of the first transition curve BC about a center line passing through the midpoint of the intermediate straight line section CD.

Example 2

In the coordinate system shown by FIG. 2, the length of the working roll body of the roll was 500 mm; the length of the two straight line sections was AB=EF=115 mm; the length of the intermediate straight line section CD was 150 mm; the projection length of the transition curves BC and DE on the x axis was 60 mm; the height of the protuberance was H=20 mm; and the curve equation of the transition curve BC was:

$$y=-4.286694\times10^{-10}x^6+1.543210\times10^{-7}x^5-1.851852\times10^{-5}x^4+7.407407\times10^{-4}x^3$$

Similarly, the transition curve DE was formed as a mirror image of the transition curve BC about a center line passing through the midpoint of the line section CD.

The rest was the same as Example 1.

Example 3

In the coordinate system shown by FIG. 2, the length of the working roll body of the roll was 500 mm; the length of the two straight line sections was AB=EF=115 mm; the length of the intermediate straight line section CD was 150 mm; the projection length of the transition curves BC and DE on the x axis was 60 mm; the height of the protuberance was H=30 mm; and the curve equation of the transition curve BC was:

$$y=-6.430041\times10^{-10}x^6+2.314815\times10^{-7}x^5-2.777778\times10^{-5}x^4+1.111111\times10^{-3}x^3$$

Similarly, the transition curve DE was formed as a mirror image of the transition curve BC about a center line passing through the midpoint of the line section CD.

The rest was the same as Example 1.

Example 4

In the coordinate system shown by FIG. 2, the length of the working roll body of the roll was 500 mm; the length of the two straight line sections was AB=EF=135 mm; the length of the intermediate straight line section CD was 150 mm; the projection length of the transition curves BC and DE on the x axis was 40 mm; the height of the protuberance was H=15 mm; and the curve equation of the transition curve BC was:

$$y=-3.6621096\times10^{-9}x^6+8.789063\times10^{-7}x^5-7.031250\times10^{-5}x^4+1.875000\times10^{-3}x^3$$

Similarly, the transition curve DE was formed as a mirror image of the transition curve BC about a center line passing through the midpoint of the line section CD.

The rest was the same as Example 1.

The profile curve of the working part of the body of the convex roll manufactured according to the technical solution of the present disclosure has first-order derivative continuity, second-order derivative continuity, and curvature continuity.

The continuous curvature convex roll manufactured according to the inventive technical solution can uniformly deform the casting bloom in the deformation zone and reduce the occurrence of cracking. The transition curve of the continuous curvature convex roll may be shortened, which can further reduce the rolling pressure and withdrawal resistance.

The disclosure can be widely applied in the field of metal casting.

What is claimed is:

1. A method of manufacturing a continuous curvature convex roll for a continuous casting bloom, wherein:

an outer profile curve of a working part of a roll body of the continuous curvature convex roll body is composed of a first straight line section (AB), a first transition curve section (BC), an intermediate straight line section (CD), a second transition curve section (DE), and a second straight line section (EF);

wherein the first transition curve section (BC), the first straight line section (AB), and the intermediate straight line section (CD) have first-order derivative continuity, second-order derivative continuity, and curvature continuity, forming a first transition curve having a continuous curvature;

wherein the second transition curve section (DE), the intermediate straight line section (CD) and the second straight line section (EF) have first-order derivative continuity, second-order derivative continuity, and curvature continuity, forming a second transition curve having a continuous curvature;

wherein the first transition curve (BC) and the second transition curve (DE) are mirror symmetrical;

wherein when manufacturing and processing the convex roll, a blank is first cast according to shape and size requirements of the convex roll, and then the working part of the roll body is formed by subjecting the blank to rotational processing along a central axis ($O_1O_2$) of the convex roll according to a shape of the outer profile curve to form the continuous curvature convex roll;

alternatively, for an existing flat roll, a protuberance is first formed on the flat roll at a position corresponding to the working part of the roll body by resurfacing welding, and then the working part of the roll body is formed by subjecting the protuberance to rotational processing along a central axis ($O_1O_2$) of the convex roll according to a shape of the outer profile curve to form the continuous curvature convex roll.

2. The method of manufacturing a continuous curvature convex roll for a continuous casting bloom according to claim 1, wherein the method of forming the first and second transition curve sections having a continuous curvature is as follows:

establishing a coordinate system, wherein an origin of coordinates (0, 0), a central point (L/2, H) and an end point (L, 0) are set; generating a convex curve passing through the origin, central point and end point, wherein the origin and the end point meet second-order derivative continuity, the central point meets first-order derivative continuity, L is a sum of projection lengths of the first and second transition curves on the x axis, and H is a height of the protuberance of the convex roll;

wherein the convex curve is a curve that is axisymmetric about a vertical line passing through the central point, the first curve section (OA) is a left half of the curve, and the second curve section (AB) is a right half of the curve; and wherein the first curve section (OA) serves as the first transition curve section; and the second curve section (AB) serves as the second transition curve section.

3. The method of manufacturing a continuous curvature convex roll for a continuous casting bloom according to claim 2, wherein the convex curve is depicted by equation:

$$y = -\frac{64H}{L^6}x^6 + \frac{192H}{L^5}x^5 - \frac{192H}{L^4}x^4 + \frac{64H}{L^3}x^3.$$

4. A continuous curvature convex roll for a continuous casting bloom, wherein:

an outer profile curve of a working part of a roll body of the continuous curvature convex roll body is composed of a first straight line section (AB), a first transition curve section (BC), an intermediate straight line section (CD), a second transition curve section (DE), and a second straight line section (EF);

wherein the first transition curve section (BC), the first straight line section (AB), and the intermediate straight line section (CD) have first-order derivative continuity, second-order derivative continuity, and curvature continuity, forming a first transition curve having a continuous curvature;

wherein the second transition curve section (DE), the intermediate straight line section (CD) and the second straight line section (EF) have first-order derivative continuity, second-order derivative continuity, and curvature continuity, forming a second transition curve having a continuous curvature;

wherein the first transition curve (BC) and the second transition curve (DE) are mirror symmetrical.

5. The continuous curvature convex roll for a continuous casting bloom according to claim 4, wherein in a coordinate system, an origin of coordinates (0, 0), a central point (L/2, H) and an end point (L, 0) are set; and a convex curve passes through the origin, central point and end point, wherein the origin and the end point meet second-order derivative continuity, the central point meets first-order derivative continuity, L is a sum of projection lengths of the first and second transition curves on the x axis, and H is a height of the protuberance of the convex roll;

wherein the convex curve is a curve that is axisymmetric about a vertical line passing through the central point, the first curve section (OA) is a left half of the curve, and the second curve section (AB) is a right half of the curve; and wherein the first transition curve section is configured according to the first curve section (OA); and the second transition curve section is configured according to the second curve section (AB).

6. The continuous curvature convex roll for a continuous casting bloom according to claim 5, wherein the convex curve is depicted by equation:

$$y = -\frac{64H}{L^6}x^6 + \frac{192H}{L^5}x^5 - \frac{192H}{L^4}x^4 + \frac{64H}{L^3}x^3.$$

* * * * *